US010323500B2

(12) United States Patent
Vuyk, Jr.

(10) Patent No.: US 10,323,500 B2
(45) **Date of Patent: *Jun. 18, 2019**

(54) CONTROL SYSTEM FOR DOWNHOLE OPERATIONS

(71) Applicant: Weatherford Technology Holdings, LLC, Houston, TX (US)

(72) Inventor: Adrian Vuyk, Jr., Cypress, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/840,011

(22) Filed: Dec. 13, 2017

(65) Prior Publication Data

US 2018/0100386 A1 Apr. 12, 2018

Related U.S. Application Data

(63) Continuation of application No. 14/123,488, filed as application No. PCT/US2012/042535 on Jun. 14, 2012, now Pat. No. 9,863,232.

(60) Provisional application No. 61/496,784, filed on Jun. 14, 2011.

(51) Int. Cl.

| | |
|---|---|
| ***E21B 44/02*** | (2006.01) |
| ***E21B 41/00*** | (2006.01) |
| ***E21B 44/00*** | (2006.01) |
| ***B21B 47/04*** | (2006.01) |
| ***E21B 47/04*** | (2012.01) |

(52) U.S. Cl.

CPC ..... *E21B 44/02* (2013.01); *E21B 41/0035* (2013.01); *E21B 44/00* (2013.01); *E21B 47/04* (2013.01)

(58) Field of Classification Search

CPC ..... E21B 44/02; E21B 41/0035; E21B 44/00; E21B 47/04

See application file for complete search history.

(56) References Cited

U.S. PATENT DOCUMENTS

| | | | |
|---|---|---|---|
| 5,488,989 | A | 2/1996 | Leising et al. |
| 6,736,210 | B2 | 5/2004 | Hosie et al. |
| 2003/0015351 | A1 | 1/2003 | Goldman et al. |
| 2005/0150692 | A1 | 7/2005 | Ballantyne et al. |
| 2005/0257930 | A1 | 11/2005 | Carter, Jr. et al. |
| 2009/0266544 | A1 | 10/2009 | Redlinger et al. |
| 2013/0213641 | A1 | 8/2013 | Layden et al. |

FOREIGN PATENT DOCUMENTS

| | | | |
|---|---|---|---|
| EP | 0 718 641 | A2 | 6/1996 |
| GB | 2 357 786 | A | 7/2001 |
| GB | 2460556 | A | 12/2009 |

(Continued)

OTHER PUBLICATIONS

EPO Office Action dated May 14, 2018, for European Application No. 12731815.2.

(Continued)

*Primary Examiner* — Michael R Wills, III

(74) *Attorney, Agent, or Firm* — Patterson + Sheridan, LLP

(57) ABSTRACT

A method of controlling a downhole operation includes: deploying a work string into a wellbore, the work string comprising a deployment string and a bottomhole assembly (BHA); digitally marking a depth of the BHA; and using the digital mark to perform the downhole operation.

20 Claims, 5 Drawing Sheets

(56) References Cited

FOREIGN PATENT DOCUMENTS

| | | | |
|---|---|---|---|
| WO | 0032904 | A1 | 6/2000 |
| WO | 2008/055266 | A1 | 5/2008 |

OTHER PUBLICATIONS

EPO Office Action dated Jul. 27, 2018, for European Application No. 12731815.2.
PCT Notification of Transmittal of the International Search Report and the Written Opinion of the International Searching Authority for Application No. PCT/US2012/042535; dated Sep. 16, 2013; 10 total pages.
Canadian Office Action for Application No. 2,838,339; dated Feb. 5, 2016; 3 total pages.
European Office Action for Application No. 12 731 815.2; dated Oct. 25, 2016; 3 total pages.

25

| | | | | | | |
|---|---|---|---|---|---|---|
| CASING SIZE | XX | XX | | | | |
| CASING WEIGHT | XX | XX | | TARGETS | | COMMENT |
| LIST OF EVENTS | DISTANCE FROM PIPE MARK | | ROP | RPM | WOB | |
| MILL BIT STARTS CUT | X.X | X.X | X TO X | X TO X | X TO X | ~~~~~~~~ |
| MILL BIT CUTS OUT | X.X | X.X | X TO X | X TO X | X TO X | ~~~~~~~~ |
| PILOT BIT STARTS CUT | X.X | X.X | X TO X | X TO X | X TO X | ~~~~~~~~ |
| TRAIL MILL STARTS CUT | X.X | X.X | X TO X | X TO X | X TO X | ~~~~~~~~ |
| MAX DEFLECTION | X.X | X.X | X TO X | X TO X | X TO X | ~~~~~~~~ |
| START OF RETRIVAL SLOT | X.X | X.X | X TO X | X TO X | X TO X | ~~~~~~~~ |
| END OF LUG | X.X | X.X | X TO X | X TO X | X TO X | ~~~~~~~~ |
| END OF RETRIEVAL SLOT | X.X | X.X | X TO X | X TO X | X TO X | ~~~~~~~~ |
| CORE POINT START | X.X | X.X | X TO X | X TO X | X TO X | ~~~~~~~~ |
| CORE POINT MID | X.X | X.X | X TO X | X TO X | X TO X | ~~~~~~~~ |
| CORE POINT END | X.X | X.X | X TO X | X TO X | X TO X | ~~~~~~~~ |
| KICK OFF POINT | X.X | X.X | X TO X | X TO X | X TO X | ~~~~~~~~ |

FIG. 4

CONTROL SYSTEM FOR DOWNHOLE OPERATIONS

CROSS-REFERENCE TO RELATED APPLICATIONS

This application is a continuation application of co-pending U.S. patent application Ser. No. 14/123,488, filed Apr. 9, 2014, which is a US national stage of International Application No. PCT/US2012/042535, filed Jun. 14, 2012, which claims benefit of U.S. Provisional Patent Application Ser. No. 61/496,784, filed Jun. 14, 2011. Each of afore mentioned patent applications are incorporated herein by reference.

BACKGROUND OF THE INVENTION

Field of the Invention

Embodiments of the present invention generally relate to a control system for downhole operations.

Description of the Related Art

In well construction and completion operations, a wellbore is formed to access hydrocarbon-bearing formations (e.g., crude oil and/or natural gas) by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Sidetrack drilling is a process which allows an operator to drill a primary wellbore, and then drill an angled lateral wellbore off of the primary wellbore at a chosen depth. Generally, the primary wellbore is first cased with a string of casing and cemented. Then a tool known as a whipstock is positioned in the casing at the depth where deflection is desired. The whipstock is specially configured to divert milling bits and then a drill bit in a desired direction for forming a lateral borehole.

SUMMARY OF THE INVENTION

Embodiments of the present invention generally relate to a control system for downhole operations. In one embodiment, a method of controlling a downhole operation includes: deploying a work string into a wellbore, the work string comprising a deployment string and a bottomhole assembly (BHA); digitally marking a depth of the BHA; and using the digital mark to perform the downhole operation.

In another embodiment, a method of performing a downhole operation in a wellbore includes monitoring operational parameters associated with the downhole operation; marking a reference point in a monitoring system; in response to the marking of a reference point, using the monitoring system to provide target values for selected operational parameters for execution of the downhole operation; and controlling the execution of the downhole operation according to the target values.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 2A illustrates a pilot bit engaging a top of the whipstock. FIG. 2B illustrates the milling operation near the start of the core point. FIG. 2C illustrates the milling operation near completion.

FIG. 4 illustrates a reference database of the control system, according to another embodiment of the present invention.

DETAILED DESCRIPTION

Figure 1:
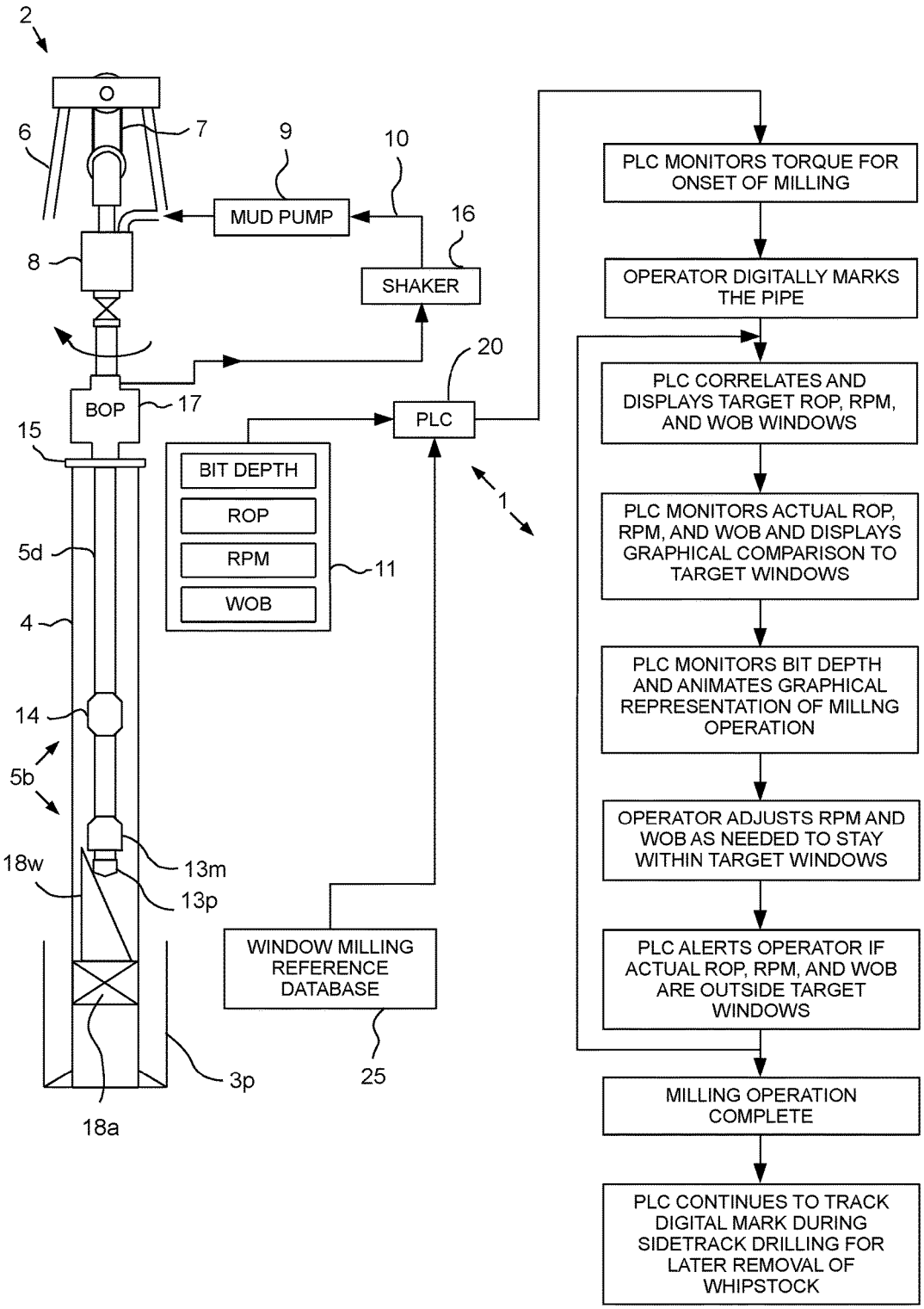
FIG. 1 is a diagram of a control system, according to one embodiment of the present invention.

FIG. 1 is a diagram of a control system 1, according to one embodiment of the present invention. The control system may be part of a milling system. A primary wellbore 3*p* has been drilled using a drilling rig 2. A casing string 4 has been installed in the primary wellbore 3*p* by being hung from a wellhead 15 and cemented (not shown, see FIG. 2A) in place. Once the casing string 4 has been deployed and cemented, a mill string 5*b,d* may be deployed into the primary wellbore 3*p* for a sidetrack milling operation.

The drilling rig 2 may be deployed on land or offshore. If the primary wellbore 3*p* is subsea, then the drilling rig may be a mobile offshore drilling unit, such as a drillship or semisubmersible. The drilling rig 2 may include a derrick 6. The drilling rig 2 may further include drawworks 7 for supporting a top drive 8. The top drive 8 may in turn support and rotate the mill string 5*b,d*. Alternatively, a Kelly and rotary table (not shown) may be used to rotate the mill string 5*b,d* instead of the top drive. The drilling rig 2 may further include a mud pump 9 operable to pump milling fluid 10 from of a pit or tank (not shown), through a standpipe and Kelly hose to the top drive 8. The milling fluid 10 may include a base liquid. The base liquid may be refined oil, water, brine, or a water/oil emulsion. The milling fluid 10 may further include solids dissolved or suspended in the base liquid, such as organophilic clay, lignite, and/or asphalt, thereby forming a mud.

The drilling rig 2 may further include a control room (aka dog house) (not shown) having a rig controller 11, such as a server 11*s* (FIG. 3), in communication with an array 12 of sensors for monitoring the milling operation. The array 12 may include one or more of: a mud pump stroke counter (Pump Strokes), a hook load cell (Hook Ld), a hook (and/or drawworks) position sensor (Hook Pos), a standpipe pressure (SPP) sensor, a wellhead pressure (WHP) sensor, a torque sub/cell (Torque), a turns (top drive or rotary table) counter (Turns), and a pipe tally (Tally). From the sensor measurements and values input by an operator, the rig controller 11 may calculate additional operational parameters, such as bit (or BHA) depth (measured and vertical), flow rate, rate of penetration (ROP), rotational speed (RPM) of the deployment string 5*b,d*, and weight-on-bit (WOB). Alternatively, one or more of these additional parameters may be measured directly as the other parameters in the array 12 or calculated by any other device or process. The rig controller 11 may also have one or more wellbore parameters stored, such as bottomhole depth (measured and vertical).

The milling fluid 10 may flow from the standpipe and into the mill string 5*b,d* via a swivel. The milling fluid 10 may be pumped down through the mill string 5*b,d* and exit a lead mill 13*m,p*, where the fluid may circulate the cuttings away from the mill and return the cuttings up an annulus formed between an inner surface of the casing 4 and an outer surface of the mill string 5*d,b*. The milling fluid 10 and cuttings (collectively, returns) may flow through the annulus to the wellhead 15 and be discharged to a primary returns line (not shown). Alternatively, a variable choke and rotating control head may be used to exert backpressure on the annulus during the milling operation. The returns may then be processed by a shale shaker 16 to separate the cuttings from the milling fluid 10. One or more blowout preventers (BOP) 17 may also be fastened to the wellhead 15. The mill string 5*b,d* may include a deployment string 5*d*, such as joints of drill pipe screwed together, and a bottom hole assembly (BHA) 5*b*. Alternatively, the deployment string may be coiled tubing instead of the drill pipe.

Figure 2A:
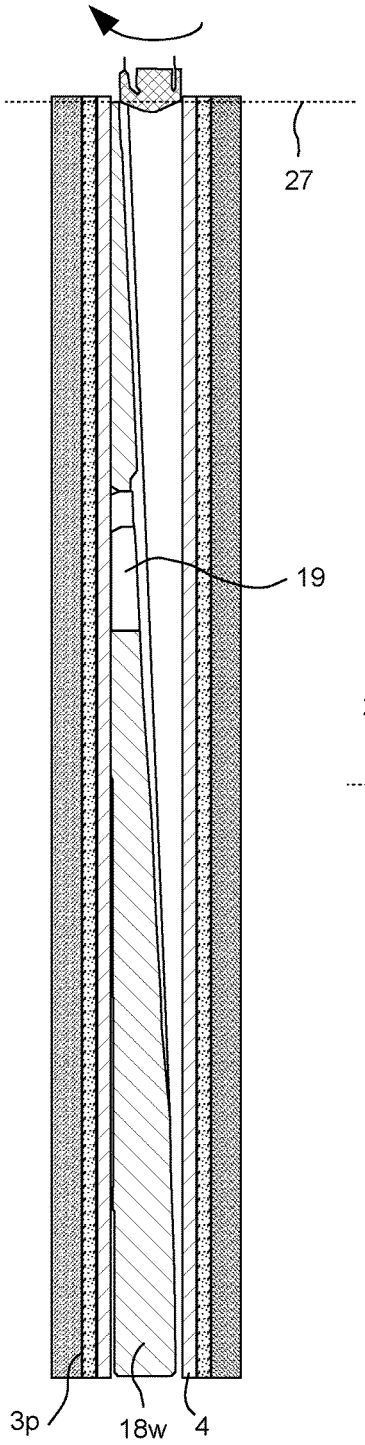
FIGS. 2A-2C illustrate a sidetrack milling operation conducted using the control system, according to another embodiment of the present invention.
Figure 2B:
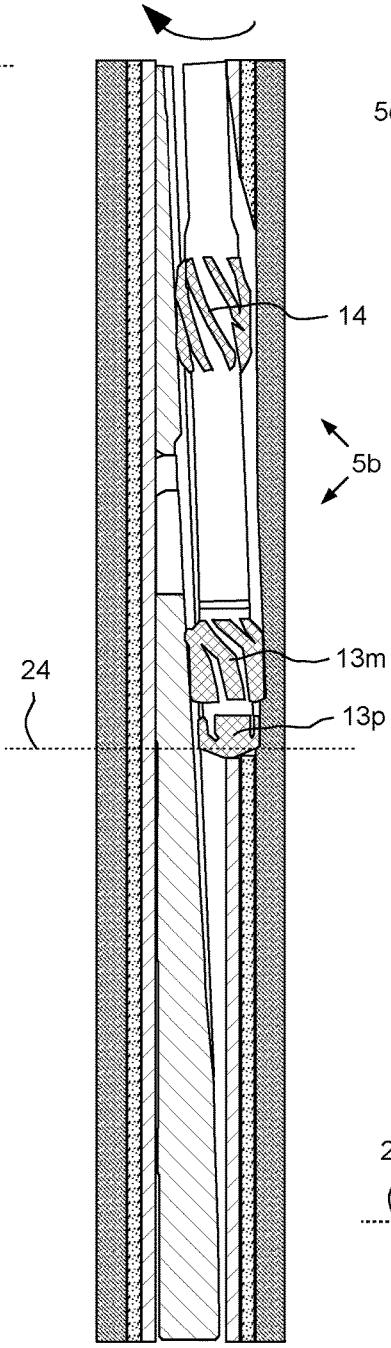
Figure 2C:
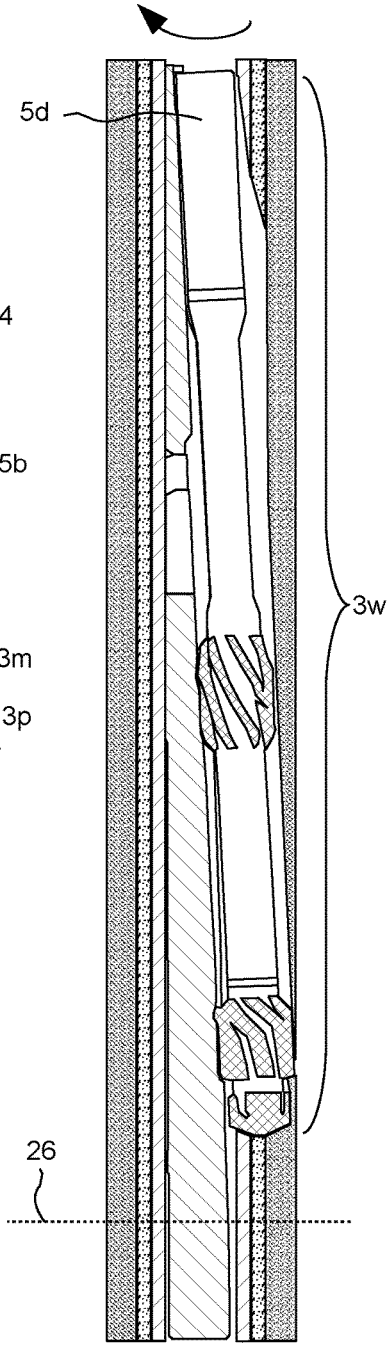

FIGS. 2A-2C illustrate a sidetrack milling operation conducted using the control system 1, according to another embodiment of the present invention. FIG. 2A illustrates a pilot bit 13*p* engaging 27 a top of the whipstock 18*w*. FIG. 2B illustrates the milling operation near a start of a core point 24. FIG. 2C illustrates the milling operation near completion. The BHA 5*b* may include the lead mill 13*m,p*, drill collars, a trail (i.e., secondary or flex) mill 14, measurement while drilling (MWD) sensors (not shown), logging while drilling (LWD) sensors (not shown), and a float valve (to prevent backflow of fluid from the annulus). The deployment string 5*d* may also include one or more centralizers (not shown) spaced therealong at regular intervals and/or the BHA 5*b* may include one or more stabilizers. The mills 13*m,p*, 14 may be rotated from the surface by the rotary table or top drive 8 and/or downhole by a drilling motor (not shown). Alternatively, the BHA may include an orienter.

The lead mill 13*m,p* may include a mill bit 13*m* and a pilot bit 13*p*. The trail mill 14 may include a mill bit. Each bit 13*m,p* 14 may include a tubular housing connected to other components of the BHA 5*b* or to the deployment string 5*d*, such as by a threaded connection. Each bit 13*m,p* 14 may further include or more blades formed or disposed around an outer surface of the housing. Cutters may be disposed along each of the blades, such as by pressing, bonding, or threading. The cutters may be made from a hard material, such as ceramic or cermet (i.e., tungsten carbide) or any other material(s) suitable for milling a window.

The milling system may further include a deflector 18*w,a*. The deflector 18*w,a* may include a whipstock 18*w* and an anchor 18*a*. The anchor 18*a* may or may not include a packer for sealing. The deflector 18*w,a* may be releasably connected (i.e., by one or more shearable fasteners) to the BHA 5*b* for deployment so that the milling operation may be performed in one trip. The anchor 18*a* may be mechanically and/or hydraulically actuated to engage the casing 4. The whipstock 18*w* may be releasably connected to the anchor 18*a* such that the whipstock may be retrieved, an extension (not shown) added, and reconnected to the anchor for milling a second window (not shown). Alternatively, the anchor and/or the deflector may be set in a separate trip.

Figure 3:
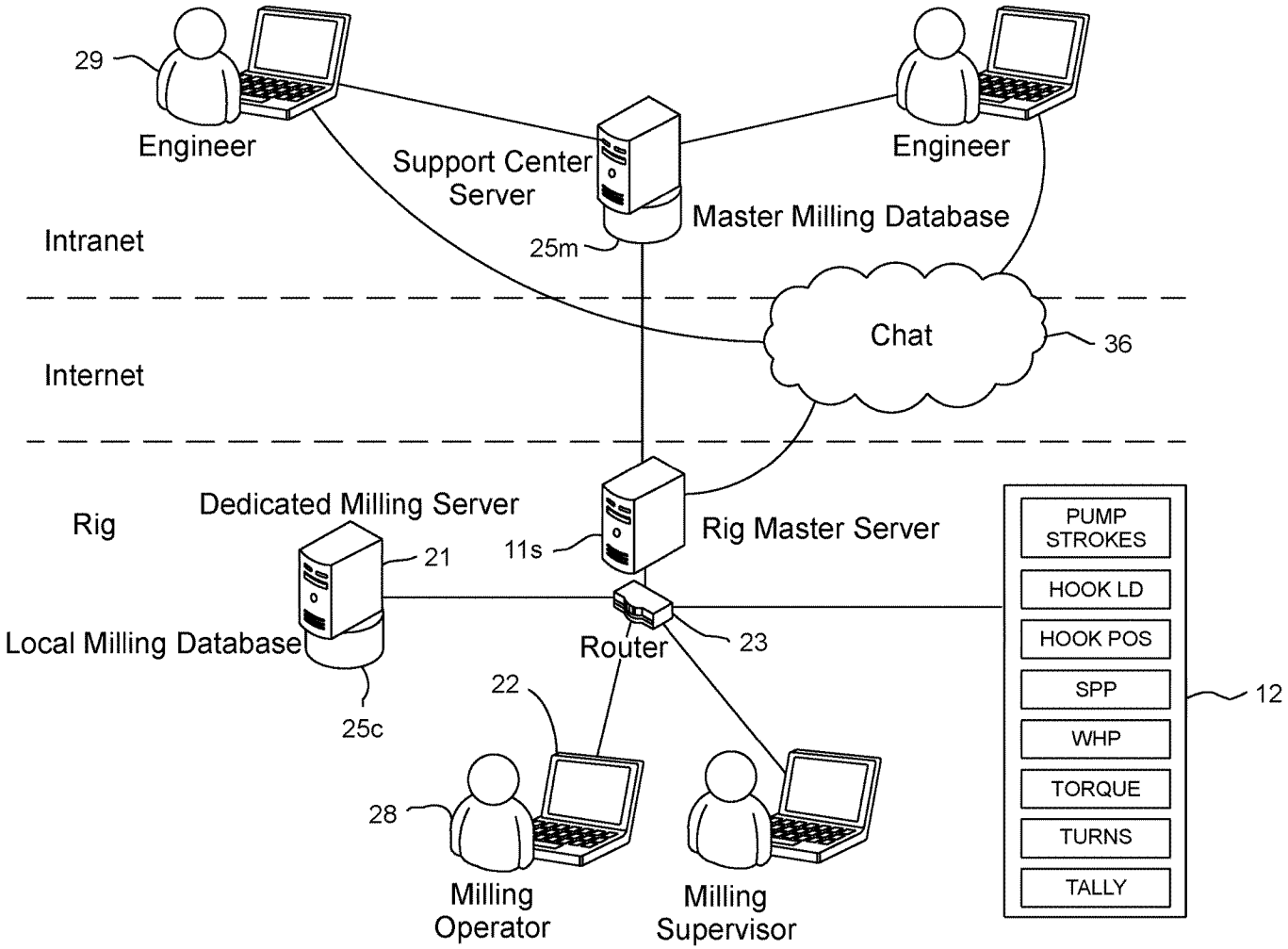
FIG. 3 illustrates a hardware configuration for implementing the control system, according to another embodiment of the present invention.

FIG. 3 illustrates a hardware configuration for implementing the control system 1, according to another embodiment of the present invention. The control system 1 may include a programmable logic controller (PLC) 20 implemented as software on one or more computers 21, 22, such as a server 21, laptop 22, tablet, and/or personal digital assistant (PDA). The software may be loaded on to the computers from a computer readable medium, such as a compact disc or a solid state drive. The computers 21, 22 may each include a central processing unit, memory, an operator interface, such as a keyboard, monitor, and a pointing device, such as mouse or trackpad. Alternatively or additionally, the monitor may be a touchscreen. Each computer 21, 22 may interface with the rig controller via a router 23 and each computer may be connected to the router, such as by a universal serial bus (USB), Ethernet, or wireless connection. The interface may allow the PLC 20 to receive one or more of the rig sensor measurements, the operational parameters, and the wellbore parameters from the rig controller 11. Each computer 21, 22 may also interface with the Internet or Intranet via the rig controller 11 or have its own connection. Alternatively, the PLC software may be loaded onto the rig controller instead of the computers.

FIG. 4 illustrates a reference database 25 of the control system 1, according to another embodiment of the present invention. The control system 1 may further include the window milling reference database 25. The database 25 may be loaded locally 25*c* on the milling server 21 and/or accessed (or updated) from a master version 25*m* possibly via the Internet and/or Intranet. The database 25 may include locations of known or expected events during a window milling operation, such as one or more of: beginning of cutting for each mill, beginning of cutout for each mill, maximum deflection, start and end of whipstock retrieval slot 19 (FIG. 2B) (may also include end of retrieval lug), start, middle, and end of the core point 24, and kickoff point 26. The locations may be a distance from a known reference point, such as a top 27 of the whipstock. The events may be used to divide the window milling operation into two or more regions, such as a cutout region, a maximum deflection region, a retrieval slot region, a core point region, and a kickoff region. The database 25 may include a set of locations for each of various casing sizes and/or weights (two different sets shown).

The database 25 may also include minimum and maximum target values of one or more milling parameters, such as ROP, RPM, and/or WOB, for each region or each event. For example, the database 25 may include a first minimum and maximum ROP for the cutout region, a second minimum and maximum ROP for the maximum deflection region, a third minimum and maximum ROP for the core point region, and a fourth minimum and maximum ROP for the kickoff region. The target values of one or more the milling parameters may be predetermined or may vary depending on values measured during the milling process. The target values of one or more the milling parameters may be constant or may vary based on a particular casing size or weight (only one set of target values shown for each parameter). If the target values of a particular milling parameter vary with casing size and/or weight, then the database may include a set of target values for the parameter for each casing size and/or weight. The database 25 may also include predetermined comments based on previous experience for one or more particular regions or events. Alternatively, the database 25 may only include a target value for one or more of the milling parameters instead of a minimum and maximum.

Figure 5:
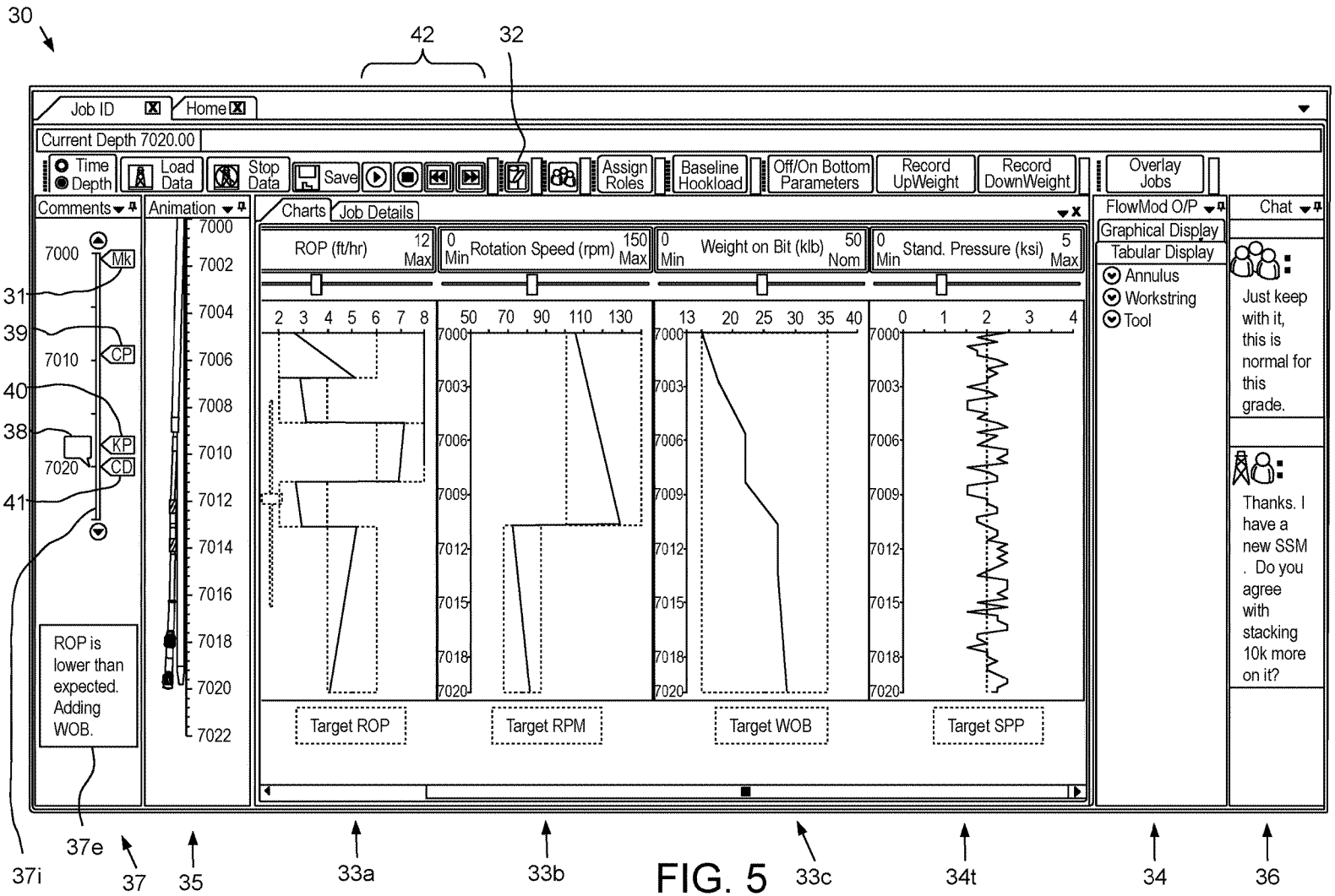
FIG. 5 is a screen shot of an operator interface of the control system.

FIG. 5 is a screen shot of an operator interface 30 of the control system 1. In operation, the operator 28 may enter (and/or the PLC 20 may receive from the rig controller) known parameters into the PLC 20, such as casing parameters (i.e., size and weight), BHA parameters (mill sizes, types, and spacing), and deflector parameters. The mill string 5*b,d* may be run into the primary wellbore 3*p* to a desired depth of the window 3*w*. The whipstock 18*w* may be oriented by rotation of the deployment string 5*d* using the MWD sensors in communication with the rig controller via wireless telemetry, such as mud pulse, acoustic, or electromagnetic (EM). Alternatively, the mill string may be wired or include a pair of conductive paths for transverse EM. The PLC may record the orientation. The anchor 18*a* may be set with the whipstock 18*w* at the desired orientation. The deflector 18*a,w* may be released from the BHA 5*b*.

The BHA 5*b* may then be rotated by rotating the deployment string 5*d* (and/or operating the drilling motor) and milling fluid 10 may be pumped to the BHA 5*b* via the deployment string 5*d*. The mill string 5*b,d* may then be lowered toward the whipstock 18*w*. The PLC 20 may monitor the torque and may calculate and monitor a torque differential with respect to time or depth. The BHA 5*b* may be lowered until the lead mill 13*p,m* (i.e., pilot bit 13*p*) engages 27 the whipstock 18*w* (FIG. 2A). The PLC 20 may detect engagement by comparing the torque differential to a predetermined threshold (from the reference database 25). The PLC 20 may then alert the operator 28 when engagement is detected and the operator may digitally mark 31 the pipe by clicking on an appropriate icon 32. The digital mark 31 may represent a reference point for the PLC 20 to monitor and control the downhole operation. Alternatively, the PLC may automatically mark the pipe. Alternatively, the operator may disregard the PLC's suggestion and mark the pipe based on experience.

Once the pipe is digitally marked 31, the PLC 20 may correlate the target values from the database 25 with BHA/bit depth by calculating the depths of the events/regions from the database 25 using the digital mark. The PLC 20 may then display a default set of target windows 33*a-c* for one or more of the operational parameters, such as ROP 33*a*, RPM 33*b*, and WOB 33*c*. If the target values for a particular operational parameter are predetermined, the PLC 20 may display the particular target window for the entire milling operation. If the target values for the particular operational parameter depend on actual measurements of the parameter or other parameters, the PLC 20 may calculate the particular target based on the actual parameter, other actual parameters, or differentials thereof, and criteria from the database 25. The criteria may vary based on the current event or region of the milling operation. The PLC 20 may then illustrate the calculated window for the current depth 41. The PLC 20 may also monitor actual values for the operational parameters (from the rig controller 11) and display plots of the various parameters for comparison against the respective target windows. The PLC 20 may receive and plot the actual values in real time. The PLC 20 may display the parameters (target and actual) plotted against time or depth (selectable by the operator). The PLC 20 may also monitor actual BHA/bit depth 41.

The PLC 20 may also interface with a flow model 34. The flow model 34 may be executed during the milling operation by the rig controller 11, the milling server 21, or an additional computer (not shown). The flow model 34 may calculate a target SPP 34*t* based on sensor measurements received from the rig controller 11. The PLC 20 may also display a target plot 34*t* for the received target SPP and plot the actual SPP (from the rig controller) for a graphical comparison. Additionally, the flow model 34 may calculate a cuttings removal rate and calculate a flow rate of the milling fluid 10 necessary to remove the cuttings. The flow model 34 may monitor the milling fluid flow rate and compare the actual flow rate to the calculated flow rate and alert the operator if the actual flow rate is less than the calculated flow rate needed for cuttings removal. The PLC 20 may also calculate a maximum flow rate based on a maximum allowable SPP, formation fracture pressure, or equivalent circulation density (ECD) limits and compare the actual flow rate to the maximum.

Alternatively, an operator may change the default target plots to illustrate target plots for one or more additional parameters, such as rathole depth.

The PLC 20 may also generate an animation 35 of the BHA 5*b*, whipstock 18*w*, and casing 4 to scale (or not to scale) and update the animation based on actual BHA/bit depth 41. The animation 35 may allow an operator 28 to view engagement of the mills 13*p,m*, 14 with the casing 4. The PLC 20 may also offset or adjust the animation 35 based on actual parameters, such as torque and/or drag. The animation 35 may also illustrate rotational speed (or velocity) of the mill string 5*b,d*.

The operator 28 may monitor the parameters displayed by the PLC 20 and make adjustments, such as altering RPM and/or WOB, as necessary to keep the operational parameters within the respective target windows. Alternatively, the rig controller may be capable of autonomous or semi-autonomous control of rig functions and the PLC may make adjustments to keep the operational parameters within the respective target windows. The operator 28 may then only monitor, subject to override of the autonomous control. The PLC 20 may also compare the actual parameters to the target windows and alert the operator 28 if any of the parameters depart from the respective target windows. The PLC 20 may also warn the operator 28 if the actual parameters approach margins of the respective windows. For the calculated windows, the PLC 20 may forecast a portion of the window and display the forecast portion to facilitate control by the operator 28. This predictive feature may allow the operator to make corrections to the operational parameters in anticipation of the forecasted changes. The PLC 20 may then correct the forecast on the next iteration. The PLC 20 may also warn the operator 28 if a differential of a particular parameter indicates that the parameter will quickly depart from the target window.

The PLC 20 may iterate in real time during the milling operation. Once the milling operation is complete (including the milling of any required rathole), the mill string 5*b,d* may be removed and the milling BHA 5*b* replaced by a drilling BHA. The drill string may be deployed and the lateral wellbore drilled through the casing window 3*w*. Alternatively, the milling BHA may be used to drill the lateral wellbore. Once drilled, the lateral wellbore may be completed, such as by expandable liner or expandable sand screen.

The PLC 20 may continue to track the digital mark 31 during the drilling and completion operations so the mark may be reused to retrieve the whipstock 14*w* or assist in passing of future completion BHA(s) through the window 3*w*. As discussed above, an extension may be added to the whipstock 14*w* for use in milling a second window. Additionally, the PLC 20 may allow the operator to make a plurality of digital marks and track the marks for future reference.

Additionally, the PLC 20 may include a chat (aka instant messaging) feature 36 allowing communication of the operator 28 with one or more remote users, such as engineers 29, located at a remote support center. The PLC 20 may also communicate with the remote support center such that the engineers 29 may view a display similar to that of the operator 28.

Additionally the PLC 20 may include a digital tally book 37. The digital tally book 37 may include a progress indicator 37*i* and a comments section. The comments section may allow the operator 28 to enter comments 37*e* during the milling operation. The comment entries 37*e* may be time and depth stamped for later evaluation and be represented by an icon 38 on the progress indicator 37*i*. The progress indicator 37*i* may be a depth-line when the depth selector is chosen and a timeline when the time selection is chosen. The digital mark 31 may be illustrated on the progress indicator 37*i*. The PLC may also illustrate one or more events using pointers, such as core point (CP) 39, kickoff point (KP) 40, and current depth 41. The comments from the database 25 may also be illustrated as icons (not shown) on the progress indicator.

The PLC 20 may save the operational data such and include a playback feature 42 such that the operation may be later evaluated. The operational data may be encoded with time and depth stamps for accurate playback.

Alternatively, the PLC may monitor actual values and display target values for setting the anchor and orienting the whipstock. The deflection angle of the whipstock may be input by the operator. The values may include azimuth, inclination, and/or tool face angle. The PLC may display the actual and target values to ensure that the correct orientation is obtained. This display may allow the operator to make adjustments based on actual data from the MWD sub to account for wellbore deviation. The PLC or the operator may digitally mark the pipe before, during, and/or after setting anchor and orienting the whipstock.

Alternatively, the PLC may include a simulator so that the milling operation may be simulated before actual performance. Alternatively, the reference database may be a historical database including the operational parameters for similar previously milled wellbores and the historical operational plots may be used instead of target windows.

Alternatively, the control system may be used with other downhole operations, such as a fishing operation for freeing and retrieving a stuck portion of a drill string. The digital pipe mark may be made when a fishing tool, such as a spear or overshot, engages the stuck portion of the drill string. The pipe mark may be tracked and reused if the stuck portion must be milled due to failure of the fishing operation. The control system may also be used for drilling out casing shoes, packers, and/or bridge plugs. The control system may also be used for setting liner hangers or packers. The control system may also be used for milling reentry of the parent wellbore (milling through a wall of the liner at the junction of the parent and lateral wellbore) as discussed and illustrated in U.S. Pat. No. 7,487,835, which is herein incorporated by reference in its entirety.

Additionally, the PLC may include additional threshold parameters for detecting actuation of the deflector. For example, WOB and/or torque differentials may be monitored and compared to thresholds to confirm actuation of the anchor and/or release of the whipstock and anchor from the BHA. Alternatively, the threshold parameters may be used to confirm other operations, such as engagement of a drill bit with a casing shoe, engagement of a liner hanger with a casing; engagement of the fishing tool with the stuck portion; or the engagement of a drill or mill bit with a bridge plug or packer.

While the foregoing is directed to embodiments of the present invention, other and further embodiments of the invention may be devised without departing from the basic scope thereof, and the scope thereof is determined by the claims that follow.

The invention claimed is:

1. A method of controlling a downhole operation, comprising:

deploying a work string into a wellbore, the work string comprising a downhole sub;

generating a digital mark in a controller to mark a depth or a time when an operational parameter based on measurements from one or more sensors reaches a threshold value; and using the digital mark as a reference point to perform the downhole operation.

2. A method for performing a downhole operation, comprising: deploying a work string into a wellbore, wherein the work string comprises a deployment string and a bottomhole assembly (BHA); generating a digital mark at a set time in a controller; and using the digital mark as a reference point in the controller to perform the downhole operation.

3. The method of claim 2, wherein the one or more sensors is positioned in the downhole sub.

4. The method of claim 3, wherein the one or more sensors are in communication with a rig controller.

5. The method of claim 4, wherein the one or more sensors are in communication with the rig controller by wireless telemetry.

6. The method of claim 4, wherein the one or more sensors are in communication with the rig controller by a wired path.

7. The method of claim 1, further comprising calculating operational parameters from the measurements of the one or more sensors.

8. The method of claim 7, wherein the operational parameters comprises one or more of depth, flow rate, rate of penetration, rotational speed, weight-on-bit, and torque.

9. The method of claim 1, further comprising generating an animation of the downhole operation using the digital mark.

10. The method of claim 9, further comprising adjusting the animation based on actual operational parameters.

11. The method of claim 10, wherein adjusting the animation comprises adjusting the animation based on at least one of torque and drag.

12. The method of claim 1, wherein the downhole operation is at least one of drilling, milling, fishing, and operating a downhole tool.

13. The method of claim 1, wherein performing the downhole operation is automated.

14. The method of claim 1, further comprising displaying one or more operational parameters using the digital mark.

15. The method of claim 14, further comprising selecting to display the one or more operational parameters against time or depth.

16. A method for performing a downhole operation, comprising:

deploying a work string into a wellbore, wherein the workstring comprises a deployment string and a bottomhole assembly (BHA);

generating a digital mark at a set time in a controller when an operational parameter based on measurements from one or more sensors reaches a threshold value; and using the digital mark as a reference point in the controller to perform the downhole operation.

17. The method of claim 16, further comprising detecting an engagement of the BHA with an object in the wellbore, wherein the digital mark is generated in response to detection of the engagement.

18. The method of claim 16, further comprising displaying target values of the downhole operation.

19. The method of claim 18, further comprising displaying an animation of the downhole operation while performing the downhole operation.

20. The method of claim 16, wherein generating the digital mark comprising generating the digital mark based on measurements of one or more sensors in the deployment string.

* * * * *